United States Patent [19]

Karakida et al.

[11] Patent Number: 5,075,187

[45] Date of Patent: Dec. 24, 1991

[54] ELECTROPHOTOGRAPHIC PHOTORECEPTOR WITH OXIDE OF AL, ZR OR TA AS CHARGE TRANSPORT LAYER

[75] Inventors: Ken-ichi Karakida; Yuzuru Fukuda; Susumu Honma; Masayuki Nishikawa; Shigeru Yagi, all of Kanagawa, Japan

[73] Assignee: Fuji Xerox Co., Ltd., Tokyo, Japan

[21] Appl. No.: 573,290

[22] Filed: Aug. 27, 1990

Related U.S. Application Data

[63] Continuation of Ser. No. 348,181, May 2, 1989, abandoned, which is a continuation of Ser. No. 93,285, Sep. 4, 1987, abandoned.

[30] Foreign Application Priority Data

Sep. 4, 1986 [JP] Japan ..... 61-206876

[51] Int. Cl.[5] ..... G03G 5/047

[52] U.S. Cl. ..... 430/58; 430/66

[58] Field of Search ..... 430/58, 60, 65, 66, 430/67

[56] References Cited

U.S. PATENT DOCUMENTS

| | | | |
|---|---|---|---|
| 4,265,991 | 5/1981 | Hirai et al. | 430/65 X |
| 4,403,026 | 9/1983 | Shimizu et al. | 430/66 X |
| 4,416,962 | 11/1983 | Shirai et al. | 430/65 |
| 4,687,723 | 8/1987 | Ohshima et al. | 430/65 |
| 4,906,545 | 3/1990 | Fukagai et al. | 430/58 |

FOREIGN PATENT DOCUMENTS

| | | | |
|---|---|---|---|
| 58-60747 | 4/1983 | Japan | 430/66 |
| 59-67543 | 4/1984 | Japan | 430/58 |
| 59-67552 | 4/1984 | Japan | 430/58 |
| 59-157652 | 9/1984 | Japan | 430/65 |

*Primary Examiner*—Roland Martin

*Attorney, Agent, or Firm*—Sughrue, Mion, Zinn, Macpeak & Seas

[57] ABSTRACT

An electrophotographic photoreceptor is disclosed which comprises a support having provided thereon a charge generating layer containing silicon as a main component and a charge transport layer containing as a main component an oxide of at least one element selected from aluminum, zirconium, and tantalum, said charge generating layer and charge transport layer being adjacent to each other. The photoreceptor has a charging capacity of about 50 V/μm or more and a rate of dark decay of 15%/sec or less.

9 Claims, No Drawings

ELECTROPHOTOGRAPHIC PHOTORECEPTOR WITH OXIDE OF AL, ZR OR TA AS CHARGE TRANSPORT LAYER

This is a continuation of application No. 07/348,181 filed May 2, 1989, now abandoned, which is a continuation of application No. 07/093,285 filed Sept. 4, 1987, abandoned.

FIELD OF THE INVENTION

This invention relates to an electrophotographic photoreceptor, and more particularly to an amorphous silicon type electrophotographic photoreceptor.

BACKGROUND OF THE INVENTION

Electrophotographic photoreceptors having a photosensitive layer consisting mainly of amorphous silicon, so-called amorphous silicon type electrophotographic photoreceptors (hereinafter referred to as a-Si photoreceptors) have recently attracted the attention because the amorphous silicon per se has a possibility of essentially improving durability of conventional electrophotographic photoreceptors and is promising for obtaining a long-life electrophotographic photoreceptor having electrically stable repeatability, high hardness, and thermal stability. Taking these advantages into consideration, various a-Si photoreceptors have been proposed, as described in Japanese Patent Application (OPI) Nos. 78135/79 and 86341/79 (the term "OPI" as used herein means an "unexamined published Japanese patent application").

Inter alia, a-Si photoreceptors having a photosensitive layer of a so-called separated function type have been considered excellent, the photosensitive layer being composed of a charge generating layer producing a charge carrier upon light irradiation and a charge transport layer in which the charge carrier generated in the charge generating layer can be introduced and transferred effectively. Various charge transport layers in such separated function type a-Si photoreceptors are known, as described, for example, in Japanese Patent Application (OPI) Nos. 172650/83 and 219561/83, and they are usually formed by decomposing a mixed gas containing a gaseous silane compound, e.g., silane, disilane, etc., a carbon-, oxygen- or nitrogen-containing gas, and a gas containing a trace amount of a Group III or Group V element, e.g., phosphine, diborane, etc., by glow discharge to provide a layer containing the abovedescribed elements to a thickness of from about 5 to 100 μm.

In the separated function type electrophotographic photoreceptors, characteristics of the charge transport layer, which has the largest thickness in the photosensitive layer, generally contribute to charging properties of the photoreceptors. The electrophotographic photoreceptors in which a charge transport layer is made of a hydrogenated amorphous silicon (hereinafter referred to as a-Si:H) obtained by the above-described glow discharge decomposition of silane compounds show insufficient charging properties as having a charging capacity of about 30 V/μm at the highest. Moreover, they generally have such an extremely high rate of dark decay as about 20%/sec at the lowest, though somewhat varying depending on conditions of use. Therefore, application of these electrophotographic photoreceptors using such an a-Si type charge transport layer has been limited to relatively high-speed systems or has required a specific development system due to insufficient charge potential attained. The charge potential can be heightened by increasing the thickness of the charge transport layer. However, such would result in increase of time required for film formation and, when applied to commonly employed processes for production, cause reduction in yield ascribed to an increase of film defect accompanying the formation of a thick layer, only to provide final products at an extremely high cost.

SUMMARY OF THE INVENTION

Accordingly, one object of this invention is to provide an electrophotographic photoreceptor having a charge transport layer, which has satisfactory charging properties and a low rate of dark decay.

Another object of this invention is to provide an electrophotographic photoreceptor which has high sensitivity and can be produced at low cost.

It is known that a metal oxide, e.g., $SiO_2$, $Al_2O_3$, $ZrO_2$, $TiO_2$, etc., is formed in a very thin film (e.g., less than 0.1 μm in thickness) between a photosensitive layer and a support of an electrophotographic photoreceptor, serving as a charge blocking layer (a charge injection-preventing layer), as described in Japanese Patent Application (OPI) Nos. 67936/82 and 60747/83. To the contrary, the inventors have found that a film of an oxide of at least one metal element selected from aluminum, zirconium, and tantalum sufficiently functions as a charge transport layer of an electrophotographic photoreceptor. The present invention has been completed based on this finding.

That is, the present invention is an electrophotographic photoreceptor comprising a support having provided thereon a charge generating layer containing silicon as a main component and a charge transport layer containing as a main component an oxide of at least one metal element selected from aluminum, zirconium, and tantalum, the charge generating layer and the charge transport layer being adjacent to each other.

DETAILED DESCRIPTION OF THE INVENTION

The charge transport layer according to the present invention contains one or more of the metal oxides as a main component, and $Al_2O_3$ is particularly preferred. The term "main component" as used herein means a component contained in a largest amount in the layer. In general, the metal oxide is contained in an amount of from about 90 to 100 atomic %, preferably from about 95 to 100 atomic %, and more preferably from about 99 to 100 atomic %, in terms of atomic ratio of the total number of atoms constituting the metal oxide(s) present in the charge transport layer to the total number of atoms constituting the charge transport layer.

The charge transport layer may further contain a hydrogen atom, and/or a Group IV or V element such as C, N, P, Si, Sn, and Pb, in an amount of less than about 10 atomic %, preferably less than about 5 atomic %, and more preferably less than about 1 atomic %.

The charge transport layer of the present invention does not have substantial photosensitivity in the visible light region; i.e., a charge carrier comprising a positive hole and an electron is not generated in the layer by irradiation of light in the visible region. The charge transport layer is, therefore, entirely different in structure from the conventional electrophotographic photosensitive layer comprising a resin binder having dispersed therein ZnO or $TiO_2$ and a sensitizing dye, or the electrophotographic photosensitive layer composed of a deposited layer of a chalcogen compound, e.g., Se, Se.Te, S, etc., and an a-Si film. The charge transport layer of the present invention may have photosensitivity to ultraviolet light.

The raw materials for the charge transport layer include aluminum, zirconium, and tantalum, and a wide range of compounds containing these elements such as $Al_2O_3$, $ZrO_2$, and $Ta_2O_5$, though depending on the method for film formation.

The charge transport layer can be formed by various methods, such as ion plating, electron beam deposition, anodic oxidation, hot spraying of an organic metal compound, CVD, and hydrolysis, as described in Y. Kawashimo et al, *Journal of The Vacuum Society of Japan,* 27, 489 (1984), Japanese Patent Application (OPI) No. 138916/81, M. Nagayama et al, *The Journal of The Metal Finishing Society of Japan,* 30, 438 (1979), Japanese Patent Application (OPI) No. 14818/72, L.A. Ryabova, *Curr. Top. Mater. Sci.,* 7, 587 (1981), and H. Dislich et al, *Thin Solid Films,* 77, 129 (1981), respectively. Among them, the ion plating method and the electron beam deposition method are advantageous from the standpoint of efficiency, and the ion plating method is particularly preferred. The method for producing the charge transport layer will be described in detail taking the ion plating method as an instance.

A raw material is put in an oxygen-free copper crucible which is placed in a vacuum chamber and can be cooled with water. Ion plating can be carried out under conditions of about $10^{-2}$ to $10^{-7}$ Torr in degree of vacuum; about 1 to +500 V. in voltage applied to an ionization electrode; 0 to about −2,000 V. in bias pressure applied to a substrate; next 0.5 to 20 KV in voltage of an electron gun; about 1 to 1,000 mA in current of an electron, gun; and about 20° to 1,000° C., preferably about 50° C. or higher, more preferably about 100° to 500° C., and most preferably about 250° to 300° C., in temperature of a substrate. The higher is the substrate temperature, the higher is the hardness of the resulting film. It is preferred that the ion plating be carried out by introducing an oxygen gas directly into the vacuum chamber since a transparent film can be obtained, which is particularly suitable when the film is formed as an upper layer on the charge generating layer because of minimum scattering or absorption of light, and the film is not likely to crack when taken out from the vacuum and cooled. In this case, the oxygen partial pressure in the vacuum chamber is preferably from about $10^{-6}$ to $10^{2}$ Torr and more preferably from about $10^{-4}$ to $10^{-1}$ Torr. The rate of deposition is generally from about 5 to 500 Å/sec, and preferably from about 10 to 200 521 /sec. The thickness of the oxide film can be adjusted appropriately by controlling ion plating time. The thickness of the charge transport layer usually ranges from about 2 to 100 μm, and preferably from about 3 to 30 μm.

The support which can be used in the present invention may be eigher electrically conductive or insulating. The conductive support includes metals and alloys, such as stainless steel and aluminum. The insulating support includes synthetic resin films or sheets, such as polyester, polyethylene, polycarbonate, polystyrene, polyamide, etc., glass, ceramics, paper, and the like. If an insulating support is used, at least the surface on which the charge generating layer and the charge transport layer are formed should be rendered electrically conductive by, for example, vacuum evaporation, sputtering or laminating of a metal usable as a conductive support. The support may have any arbitary shape, such as tube, belt, plate, etc. Further, the support may have a multilayer structure. The thickness of the support is determined appropriately depending on the desired photoreceptor and is usually 10 μm or more.

The charge generating layer of the present invention contains, as a main component, silicon which may be polycrystalline, microcrystalline, or amorphous in the crystalline form. Crystalline silicon can be obtained by heating amorphous silicon or forming a silicon film at a high temperature. Of these, amorphous silicon (a-Si) is preferably used in the present invention. The charge generating layer is herein explained referring to a-Si as one example of the silicon component.

The silicon content in the charge generating layer may be 100 atomic % based on the total number of atoms constituting the layer, but it is preferably from about 95 to 50 atomic % and more preferably from about 90 to 60 atomic %. In the case of an a-Si film, a hydrogen atom is generally contained in an amount of less than about 20 atomic %. The charge generating layer may further contain less than 50 atomic % of a halogen atom, C, O, N, Ge and Sn, and a trace amount of B and P.

The charge generating layer can be formed by various methods, such as glow discharge, sputtering, ion plating, and vacuum evaporation, as described in Japanese Patent Application (OPI) Nos. 78135/79, 62778/80, 78414/81 and 70234/83, respectively. Preferably, the charge generating layer is formed by glow discharge decomposition of silane (SiH4) or a silane-based gas according to a plasma CVD method, as described in Japanese Patent Application (OPI) No. 78135/79. A film formed by this technique contains an adequate amount of hydrogen and exhibits favorable characteristics as a charge generating layer, i.e., relatively high dark resistance and high photosensitivity.

The plasma CVD method is illustrated below. Raw materials for forming a charge generating layer include silane compounds such as monosilane and disilane. If desired, a carrier gas, e.g., hydrogen, helium, argon, neon, etc., may be used in the formation of the charge generating layer. The amount of the carrier gas to be introduced is generally from 0 to about 90 parts by volume, preferably from 0 to about 60 parts by volume, per part by volume of silane compound. For the purpose of control of dark resistance or charge polarity of the charge generating layer, an impurity element, e.g., boron and phosphorus, can be incorporated into the film by adding a dopant gas, e.g., diborane ($B_2H_6$), phosphine ($PH_3$), etc., to the above-described gas. For example, the amounts of diborane and phosphine are generally from 0 to about 300 ppm and from 0 to about 200 ppm, preferably from 0 to about 30 ppm and from 0 to about 20 ppm, respectively, per part by volume by $SiH_4$. For the purpose of increasing dark resistance, photosensitivity or charging capacity (charging capacity or charge potential per unit film thickness), the charge generating layer may further contain a halogen atom, a carbon atom, an oxygen atom, a nitrogen atom, etc. in an amount of from 0 to about 50 atomic % and preferably from 0 to about 20 atomic % based on the total number of atoms constituting the charge generating layer. For the purpose of increasing sensitivity in the longer wavelength region, it is also possible to incorporate germanium, tin or other elements in an amount of from about 1 to 50 atomic % and preferably from about 1 to 30 atomic % based on the total number of atoms constituting the charge generating layer. In particular, the charge generating layer preferably contains silicon as a main component and from about 1 to 40 atomic %, more preferably from about 5 to 20 atomic %, of hydrogen, based on the total number of atoms constituting the charge generating layer.

The film thickness of the charge generating layer is generally in the range of from about 0.1 to 30 μm, and preferably from about 0.2 to 5 μm. The charge generating layer may be provided either on or beneath the charge transport layer.

If desired, the electrophotographic photoreceptor according to the present invention may further comprise additional layers in contact with an upper or lower layer of the combination of the charge generating layer and the charge transport layer. Such additional layers include a charge blocking layer embracing a p-type or n-type semi-conductor layer composed of amorphous silicon having incorporated therein the Group III or V element and an insulating layer composed of silicon nitride, silicon carbide, silicon oxide, amorphous carbon, etc.; an adhesive layer composed of amorphous silicon having incorporated therein nitrogen, carbon, oxygen, etc.; a layer containing both an element of the Group III and an element of the Group V; a layer controlling electrical characteristics and image quality of a photoreceptor; and the like. Each of these additional layers may have an arbitarily determined thickness and usually ranges from about 0.01 to 10 μm. These additional layers are described in Japanese Patent Application (OPI) Nos. 78135/79, 52159/82, 125881/81, 63545/82, and 136042/83.

In order to inhibit charge injection from the surface of the photoreceptor and/or the surface of the support into the charge transport layer or charge generating layer to ensure sufficient charging capacity and low dark decay, it is particularly preferred to provide a charge blocking layer between the support and the charge generating layer or charge transport layer and/or the surface of the photoreceptor.

In addition, a surface protective layer may be provided in order to prevent the surface of the photoreceptor from denaturation due to corona ions, as described in Japanese Patent Application (OPI) Nos. 115551/82 and 275852/86.

The charge generating layer and the additional layers can be formed by a plasma CVD method. As explained for the charge generating layer, in the case of incorporating an impurity element to these layers, a gaseous compound containing such an impurity element is introduced to an apparatus of plasma CVD together with a silane gas to effect glow discharge decomposition. The film formation can be carried out effectively by means of either alternating current discharge or direct current discharge. Taking alternating current discharge for instance, conditions for the film formation are usually from about 0.1 to 30 MHz, and preferably from about 5 to 20 MHz, in frequency; from about 0.1 to 5 Torr (from about 13.3 to 66.7 Pa) in pressure at the time of discharge; and from about 100° to 400° C. in temperature of the substrate.

It has not yet been elucidated why the film made of an oxide of at least one element selected from aluminum, zirconium, and tantalum functions as a charge transport layer. It is considered that the charge carrier generated in the charge generating layer adjacent thereto is effectively transported without being trapped at the interface therebetween and, at the same time, the charge transport layer functions to inhibit unnecessary charge injection from the side of the support. Thus, the electrophotographic photoreceptor in accordance with the present invention has a charging capacity of approximately 50 V/μm or more and a rate of dark decay as low as 15 %/sec or less.

The present invention will now be illustrated in detail with reference to the following examples, but it should be understood that these examples are not deemed to limit the present invention.

EXAMPLE 1

An aluminum oxide film was formed around an aluminum pipe having a diameter of about 120 mm by ion plating as follows. Alumina having a purity of 99.99% was charged in an oxygen-free copper crucible under water-cooling placed in a vacuum chamber. After the inner pressure of the vacuum chamber was adjusted to $2\times10^{-5}$ Torr, oxygen gas was fed to the vacuum chamber at a controlled flow rate so as to maintain the degree of vacuum at $2\times10^{-4}$ Torr. A voltage of 8.5 KV was applied to an electron gun, and the powder source was set to fix the electrical current at 240 mA. At this time, the voltage of the ionization electrode was fixed at 80 V, and to the support was applied a bias voltage of −500 V. The power of the electron beam was controlled so that the rate of deposition was fixed at 34 Å/sec by the use of a film thickness monitor with a quartz oscillator placed in the vicinity of the support. After about 25-minute film formation, the sample was taken out from the vacuum system to obtain an aluminum pipe covered with a transparent film of aluminum oxide to a thickness of about 5 μm.

Thereafter, an a-Si:H (non-doped: H 17 atomic %) film was formed on the aluminum oxide film to a thickness of 1 μm as follows. Silane ($SiH_4$) gas was fed to a capacity coupling type plasma CVD apparatus at a rate of 200 cc/min, and the inner pressure was adjusted to 1.5 Torr. The temperature of the support was 250° C. Glow discharge decomposition was carried out at an output of 300 W at a high frequency of 13.56 MHz for 10 minutes.

The thus obtained sample was charged by corona discharge while rotating at 40 rpm. The surface potential after 0.1 second from the corona discharge was about −260 V. at the time when an electrical current of −20 μA/cm flowed into the photoreceptor. The half decay exposure was 5.8 erg/cm$^2$ upon exposure to monochromatic light of 550 nm, and the residual potential at this time was about −30 V. The rate of dark decay was 15%/sec.

EXAMPLE 2

A 1 μm thick a-Si:H film was laminated on an aluminum oxide film having a thickness of about 5 μm in the same manner as described in Example 1. Subsequently, an a-Si:N (N-doped: atomic ratio N/Si=0.45/1) film of 600 Å thick was laminated thereon as a surface protective layer in a plasma CVD apparatus.

The conditions for the a-Si:N film formation were as follows:

| | |
|---|---|
| Silane flow rate: | 50 cc/min |
| Ammonia flow rate: | 30 cc/min |
| Hydrogen flow rate: | 200 cc/min |

-continued

| | |
|---|---|
| Inner pressure of reaction vessel: | 0.7 Torr |
| Discharge output: | 100 W |
| Discharge time: | 6 minutes |
| Support temperature: | 250° C. |

When the thus prepared sample was subjected to corona discharge while rotating at 40 rpm, the surface potential after 0.1 second from the corona discharge was about −360 V. at the time when a current of −20 μA/cm flowed into the photoreceptor, indicating an improvement in charging capacity over the photoreceptor of Example 1. The half decay exposure was 8.0 erg/cm$^2$ on exposure of monochromatic light of 550 nm, and the residual potential at this time was about −65 V. The rate of dark decay was 14%/sec.

EXAMPLE 3

An a-Si:N film (a charge blocking layer) was formed on an aluminum pipe to a thickness of about 600 Å according to a plasma CVD method under the same conditions as used in Example 2. An aluminum oxide film of 5 μm thick was further formed thereon under the same conditions as used in Example 1. Then, a 1 μm thick a-Si:H (non-doped) film and a 600 μm thick a-Si:N film were laminated thereon in the same manner as in Example 2.

The resulting sample was subjected to corona discharge while rotating at 40 rpm. The surface potential after 0.1 second from the corona discharge was about −520 V. at the time when a current of −20 μA/cm flowed into the photoreceptor. The half decay exposure was 9.2 erg/cm$^2$ on exposure to monochromatic light of 550 nm, and the residual potential at this time was about −80 V. The rate of dark decay was 8 %/sec.

EXAMPLE 4

On an aluminum pipe were laminated an a-Si:N blocking layer of 600 Å thick, an a-Si:H (non-doped) layer of 1 μm thick and then, after once taking out from the vacuum system, an aluminum oxide film of 5 μm thick in the same manner as in Example 3, wherein the order of the aluminum oxide film and the a-Si:H film was reversed.

When the resulting sample was charged by corona discharge while rotating at 40 rpm, the surface potential after 0.1 second from the corona discharge was about 350 V. at the time when a current of +20 μA/cm flowed into the photoreceptor. The half decay exposure was 7.5 erg/cm$^2$ on exposure to monochromatic light of 550 nm, and the residual potential at this time was 70 V. The rate of dark decay was 14 %/sec.

EXAMPLE 5

On the sample of Example 4 was laminated an a-Si:N film having a thickness of about 600 Å as a surface protective layer by a plasma CVD method under the same conditions as used in Example 2.

When the resulting sample was charged by corona discharge while rotating at 40 rpm, the surface potential after 0.1 second from the corona discharge was about 450 V at the time when a current of 20 μA/cm flowed into the photoreceptor. The half, decay exposure was 10.5 erg/cm$^2$ on exposure to monochromatic light of 550 nm, and the residual potential at this time was about 90 V. The rate of dark decay was 9 %/sec.

When the sample was mounted on a dry process paper copying machine (Model 3500, manufactured by Fuji Xerox Co., Ltd.) to carry out copying, clear images free from fog were obtained.

EXAMPLE 6

A $Ta_2O_5$ film was formed on a 1 mm thick stainless steel base by ion plating as follows. $Ta_2O_5$ (purity: 99.9%) was placed in an oxygen-free copper crucible under water-cooling. After the degree of vacuum was maintained at $2\times10^{-5}$ Torr, oxygen gas was introduced to the vacuum chamber at a controlled flow rate so as to maintain the degree of vacuum at $2\times10^{-4}$ Torr. A voltage of 8.5 KV was applied to an electron gun, and the power source was adjusted so as to result in an electric current of 250 mA. At this time, the voltage of the ionization electrode was set at 80 V., and a bias voltage of −1,000 V was applied to the base. The power of the electron beam was controlled so as to obtain a constant rate of deposition of 35Å/sec by means of a film thickness monitor with a quartz oscillator placed in the vicinity of the base. After film formation for about 25 minutes, the stainless steel base was taken out from the vacuum system to obtain a sample having provided thereon a transparent film of about 5.3 μm thick. On the thus formed film were further laminated an a-Si:H (non-doped) film having a thickness of 1 μm and an a-Si:N film having a thickness of 600 Å in the same manner as in Example 2.

When the resulting sample was negatively charged by corona discharge, the surface potential after 0.1 second from the corona discharge was about −300 V at the time when a current of −20 μA/cm flowed into the photoreceptor The half decay exposure was 16.8 erg/cm$^2$ on exposure to monochromatic light of 550 nm, and the residual potential at this time was about −110 V. The rate of dark decay was 15%/sec.

EXAMPLE 7

A solution consisting of 10 parts (by weight; hereinafter the same) of zirconium tetrapropoxide, 100 parts of isopropyl alcohol, and 1 part of a 1 wt % hydrochloric acid aqueous solution was prepared. An aluminum plate was dipped in the solution, followed by heating at 250° C. for 3 hours to form a transparent thin film composed mainly of zirconium and oxygen to a thickness of 3 μm.

Onto the thus formed film were laminated a 1 μm-thick a-Si:H film and then a 600 Å-thick a-Si:N film as a surface layer in the same manner as in Example 2.

When the resulting photoreceptor was negatively charged by corona discharge and exposed to monochromatic light of 550 nm, the surface potential after 0.1 second from the corona discharge was −200 V. at the time when a current of −20 μA/cm flowed into the photoreceptor, and the residual potential after the exposure was −50 V. The rate of dark decay was 5%/sec.

EXAMPLE 8

An aluminum base was dipped in a solution consisting of 10 parts of aluminum isopropoxide, 200 parts of ethyl alcohol, and 10 parts of a 1 wt % hydrochloric acid aqueous solution and dried at 300° C. for 3 hours to form a 5 μm thick transparent film composed mainly of aluminum and oxygen.

On the film thus formed were laminated a 1 μm-thick a-Si:H film and, as a surface layer, a 600 Å-thick a-Si:N film in the same manner as in Example 2.

When the resulting photoreceptor was negatively charged by corona discharge and exposed to monochromatic light of 550 nm, the surface potential after 0.1 second from the corona discharge was −300 V at the time when a current of −20 μA/cm flowed into the photoreceptor, and the residual potential after the exposure was −60 V. The rate of dark decay was 12 %/sec.

As described above, the electrophotographic photoreceptor according to the present invention exhibits satisfactory charging properties and low rate of dark decay. That is, the photoreceptor of the present invention has a charging capacity of about 50 V/μm or more, a rate of dark decay of 15 %/sec or less, and a high sensitivity.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a support having provided thereon a charge generating layer containing silicon as a main component and a charge transport layer containing as a main component an oxide of at least one element selected from aluminum, zirconium, and tantalum, said charge generating layer and charge transport layer being adjacent to each other, wherein said charge transport layer has a thickness of from about 2 to 100 μm. wherein said charge generating layer contains amorphous silicon as a main component and from about 1 to 40 atomic % of hydrogen atom based on the total number of atoms constituting the charge generating layer, and wherein said charge generating layer has a thickness of from about 0.1 to 30 μm.

2. An electrophotographic photoreceptor as claimed in claim 1, wherein said charge transport layer has no substantial photosensitivity in the visible light region.

3. An electrophotographic photoreceptor as claimed in claim 1, wherein said photoreceptor further comprises a charge blocking layer between the support and a lower layer of the combination of the charge generating layer and the charge transport layer.

4. An electrophotographic photoreceptor as claimed in claim 1, wherein said oxide is contained in the charge transport layer in an amount of from about 90 to 100 atomic % in terms of atomic ratio of the total number of atoms constituting the oxide to the total number of atoms constituting the charge transport layer.

5. An electrophotographic photoreceptor as claimed in claim 4, wherein said oxide is contained in the charge transport layer in an amount of from about 95 to 100 atomic %.

6. An electrophotographic photoreceptor as claimed in claim 1, wherein said charge transport layer has a thickness of from about 3 to 30 μm.

7. An electrophotographic photoreceptor as claimed in claim 1, wherein the amount of hydrogen atom is from about 5 to 20 atomic %.

8. An electrophotographic photoreceptor as claimed in claim 1, wherein said charge generating layer has a thickness of from about 0.2 to 5 μm.

9. An electrophotographic photoreceptor comprising a support having provided thereon a charge generating layer containing silicon as a main component and a charge transport layer consisting essentially of, as a main component, an oxide of at least one element selected from aluminum, zirconium, and tantalum, said charge generating layer and charge transport layer being adjacent to each other, wherein said charge transport layer has a thickness of from about 2 to 100 μm, wherein said charge generating layer contains amorphous silicon as a main component and from about 1 to 40 atomic % of hydrogen atom based on the total number of atoms constituting the charge generating layer, and wherein said charge generating layer has a thickness of from about 0.1 to 30 μm.

* * * * *